US005150948A

United States Patent [19]

Völkle

[11] Patent Number: 5,150,948

[45] Date of Patent: Sep. 29, 1992

[54] RECLINING CHAIR

[76] Inventor: Rolf Völkle, Hohenholz 1, D-7298 Lossburg, Fed. Rep. of Germany

[21] Appl. No.: 580,461

[22] Filed: Sep. 11, 1990

[30] Foreign Application Priority Data

Sep. 16, 1989 [DE] Fed. Rep. of Germany ..... 3930983

[51] Int. Cl.[5] ..... A47C 1/032

[52] U.S. Cl. ..... 297/301; 297/317; 297/353

[58] Field of Search ..... 297/301, 317, 318, 320, 297/353

[56] References Cited

U.S. PATENT DOCUMENTS

| | | | |
|---|---|---|---|
| 2,471,024 | 5/1949 | Cramer | 297/301 |
| 4,502,729 | 3/1985 | Locher | 297/301 |
| 4,687,250 | 8/1987 | Esche | 297/301 X |
| 4,693,514 | 9/1987 | Völkle . | |
| 4,848,837 | 7/1989 | Völkle . | |

FOREIGN PATENT DOCUMENTS

| | | | |
|---|---|---|---|
| 0309804 | 4/1989 | European Pat. Off. . | |
| 3322450 | 1/1985 | Fed. Rep. of Germany . | |
| 8806835 | 10/1985 | Fed. Rep. of Germany . | |
| 3735256 | 9/1989 | Fed. Rep. of Germany . | |
| 2533428 | 3/1984 | France | 297/301 |
| 724329 | 2/1955 | United Kingdom | 297/317 |

*Primary Examiner*—Peter R. Brown

*Attorney, Agent, or Firm*—Spencer, Frank & Schneider

[57] ABSTRACT

A chair which is provided with a seat having an adjustable inclination comprises a seat carrier, which is pivoted by a first pivot to a link arrangement which carry the seat, a back rest, which is carried by a back rest carrier, which is pivoted to the link arrangement by a second pivot, and a device for shifting the chair from a position for work, in which the seat is approximately horizontal and includes with the back rest an angle of about 90 degrees, to a position for reclining, in which the seat is rearwardly inclined and includes an obtuse angle with the back rest. The shift from the position for reclining to the position for work is effected by movements of the body of the occupant and is assisted by springs. The seat carrier is provided with slide bearings and slots, in which the first pivot is displaceable away from the column as the chair is shifted to its position for reclining. The pivotal movement which is imparted to the back rest by the movement of the body of the occupant is adapted to be a transformed to the displacement by a shifting device which includes pairs of levers. Owing to that design, the center of gravity is displaced so that the back rest can be swung further to the rear without a risk that the stability of the chair might be endangered.

11 Claims, 8 Drawing Sheets

RECLINING CHAIR

BACKGROUND OF THE INVENTION

1. Field of the Invention

This invention relates to a reclining chair having a seat and a back rest, each of which has an adjustable inclination, a base comprising a vertically adjustable column and a seat carrier, which is supported by the column and has a forward end to which link means, which carry the seat are pivoted by a first pivot, also comprising a second pivot, by which said link means are at their rear end to the back rest, and shifting means for shifting the chair from a position for work, in which the seat is approximately horizontal and includes an angle of about 90° with the back rest, to a position for reclining, in which the seat is rearwardly inclined and includes an obtuse angle with the back rest, and to at least one intermediate position, which shifting can be effected in that a pivotal movement is imparted to the back rest by an occupant, wherein locking means are provided to lock the chair in any of said positions and the shifting from the position for reclining to the position for work is assisted by spring means.

2. Description of the Prior Art

A reclining chair of that kind is known from DE 36 35 044 Al (corresponding to U.S. Pat. No. 4,848,837) and comprises synchronizing levers for constraining the seat and the back rest to perform angular movements through angles having a ratio of 1:2.5. That known chair is adapted to be locked in all adjusted positions by means of a set of disks, which are compressed to be in frictional contact with each other by thrust pins extending through said disks. The pivotal movement of the back rest toward the rear is limited by the largest possible displacement of the center of gravity during the movement from the position for work to the position for reclining and there will be a risk of a tilting of the chair if the center of gravity is displaced further.

Similar remarks are applicable to a known reclining chair which is of a comparable kind and in which the angular movements performed by the seat and the back rest during a shift from the position for work to the position for reclining have a ratio of about 1:2 (WO 86 00508 (corresponding to U.S. Pat. No. 4,693,514)—FIGS. 6, 6*a*).

In another reclining chair known from DE 37 35 256 Al the problem that the pivotal movement of the back rest to the rear must strictly be limited to avoid a tilting of the chair has not been solved too. In that chair it is merely possible to lower the rear portion of the seat and to incline the back rest, which is connected to the seat. During a change of the inclination of the back rest the forward portion of the seat virtually retains its previous inclination and previous elevation.

Similar remarks are applicable to another reclining chair which is known from German Utility Model 88 06 835 and in which a seat is pivoted to a bracket, a back rest is linked to the bracket by a lever, and said seat and said back rest can be inclined to the rear without a relative movement between the clothes of an occupant and the back rest.

It is also known from Published European Patent Application 0 309 804 that a pivot provided adjacent to the forward edge of the seat of the chair can be horizontally displaced. In that chair the subassembly consisting of the seat and the back rest is pivoted to the rear end of side arms, which define a center of gravity that is disposed at or close to the center of gravity of the chair when the latter is occupied. That chair cannot be provided without arm rests.

It is also known that the seat and the back rest can be swung to the rear with an overproportional pivotal movement of the back rest whereas the forward pivot of the seat is moved rearwardly in an almost horizontal guide (DE 33 22 450 Al).

SUMMARY OF THE INVENTION

It is an object of the invention so to improve a reclining chair which is of the kind described first hereinbefore that the shifting of the chair to its position for reclining can automatically and infinitely be effected conveniently by a very large pivotal movement of the back rest relative to the seating surface as a result of suitable movements of an occupant and that this will not adversely affect the stability of the chair.

That object is accomplished in accordance with the invention in that the seat carrier is provided with slide bearings, the first pivot is slidably movable along said slide bearings away from the column during a shifting of the chair from its position for work to a position for reclining, and shifting means are provided for deriving said sliding movement from the pivotal movement which is imparted to the back rest by the movement of the occupant.

In such an arrangement the overall center of gravity of the unit consisting of the chair and the occupant is kept close to the carrying column by common forward movement of the link means, seat and back rest together with the occupant so that the comfort is increased because the back rest can be swung further to the rear without a risk of a tilting of the chair.

In accordance with a further feature of the invention the shifting means comprise:

a) a pair of first levers, which are pivoted to the seat carrier by a third pivot and to the link means by a fourth pivot, and b) a pair of second levers, which are pivoted at one end by means of a fifth pivot to the first levers at the top thereof and which are pivoted at the other end to the back rest by a sixth pivot, which is spaced from the second pivot. That arrangement permits a relatively smooth shifting of the chair from its position for work to its position for reclining and vice versa.

In accordance with further features of the invention the longitudinal axis each first lever is forwardly inclined when the chair is in position for reclining in that position the angle included by said longitudinal axis with the vertical is larger than the corresponding angle when the chair is in position for work, and the distance between the third and sixth pivots is more than one and a half times as large in position for work than in position for reclining. During a shifting of the chair from the position for work to the position for reclining the center lines of the first levers and the back rest are pivotally movable through maximum angles which are approximately equal. Each of the first and second pairs of levers consist of two congruent levers, which are symmetrical to the plane of symmetry of the chair, the first levers have approximately the basic configuration of a triangle, and the bores for the pivots for said first levers are disposed near the rounded corners of said trangle. During the shifting of the chair from its position for work to its position for reclining the instantaneous centers of rotation of the rocker lie in the plane of displacement and said plane intersects the first levers between the third pivot and the fifth pivot. That arrangement will permit an extremely soft shifting from the position for work to the position for reclining and vice versa.

In accordance with a preferred feature the direction of the sliding movement of the slide bearings includes an angle of about 15° with the horizontal and the free ends of the first pivot are fixed to sliding blocks, which are guided in the slide bearings of the seat carrier, which consist of quadrangular-section sleeves and are provided with slots, through which the opposite ends of the first pivot extend to the slide blocks. As a result, the forward edge of the seat will remain approximately on the same level as the chair is shifted between its various positions so that the feet of the occupant will not be lifted from the floor or ground. Besides, the slide bearings are so designed that the displacement of the first pivot will be effected reliably and without wear.

In accordance with a further feature that the back engaging part of the back rest is slidably mounted on the back rest carrier and engageable by the back of the occupant and can be pulled by means of a rope toward the seat against the force of at least one spring during a shifting from the position for work to the position for reclining and said rope is connected at one end to the back-engaging part and at the other end to the link means. As a result, the relative movement between the clothes of the occupant and the back rest is decreased, possibly to zero. That relative movement has been reduced in any case by the sliding movement of the link means.

In accordance with a further feature a coil spring is provided, which is disposed in the longitudinal vertical plane of symmetry of the chair and bears on an abutment of the seat carrier and is connected to the first pivot and is provided with means for adjusting the initial stress of said spring. In that case the restoring force to be exerted by the spring for the shifting of the chair from its position for reclining to its position for work can be adjusted in dependence on the weight of the occupant. An adjustment of the initial stress to an optimum value will result in a comfortable resilient cushioning of the seat.

The reclining chair combines the comfortable resilient cushioning of its seat with the possibility that the chair can be shifted to any desired position for reclining so that a dynamic sitting in adaptation to the desires of the occupant will be permitted. Besides, the spine can be spent back to an extreme extent with a resulting expansion of the stomach and abdominal regions by an extreme pivotal movement of the back rest to the rear, as is often desired by an occupant. During all said movements the occupant will always have a comfortable contact with the seat and at its back.

DETAILED DESCRIPTION OF THE PREFERRED EMBODIMENTS

Figure 1:
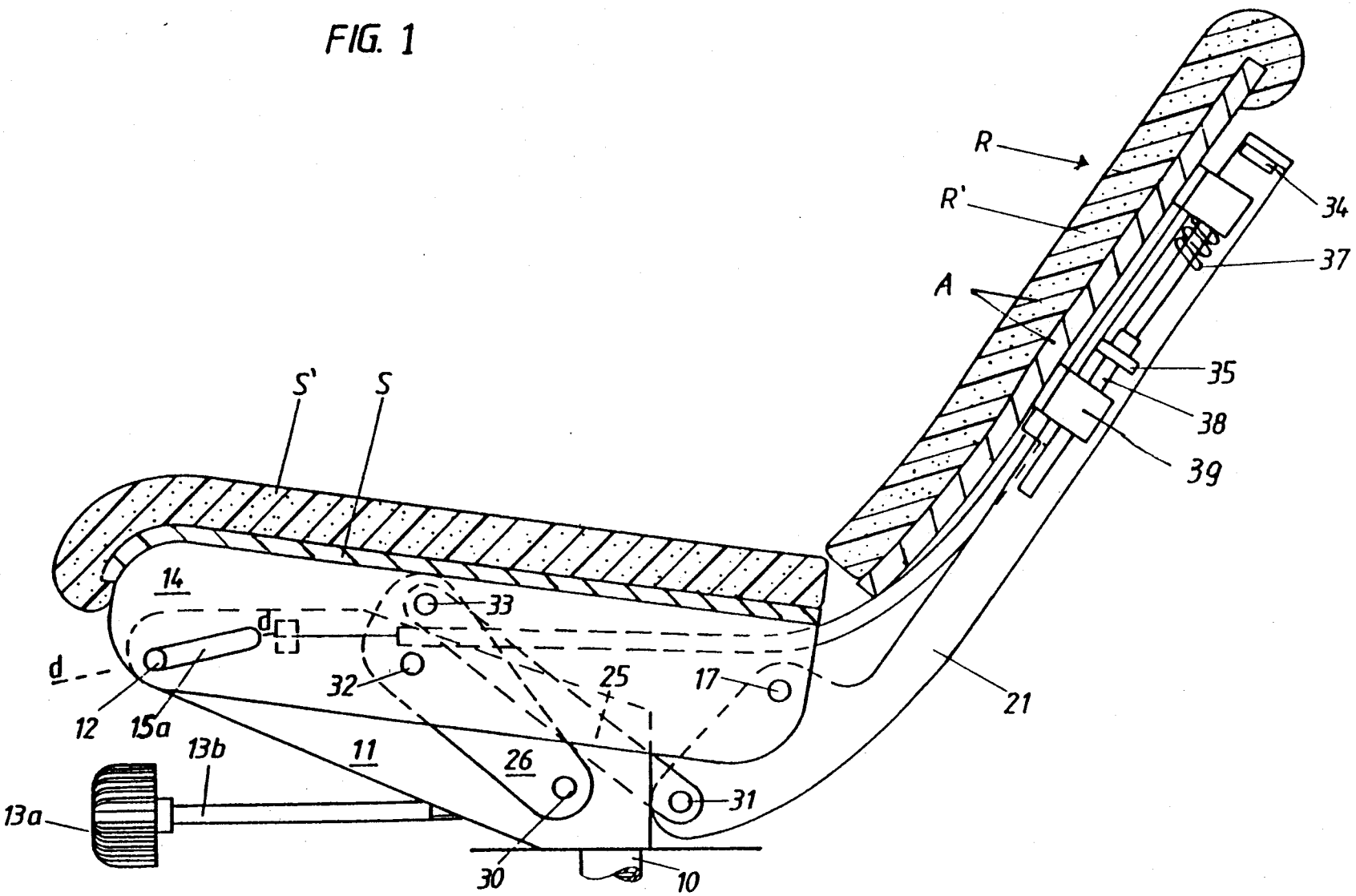
FIGS. 1 and 2 show the reclining chair in respective positions for reclining and for work.
Figure 2:
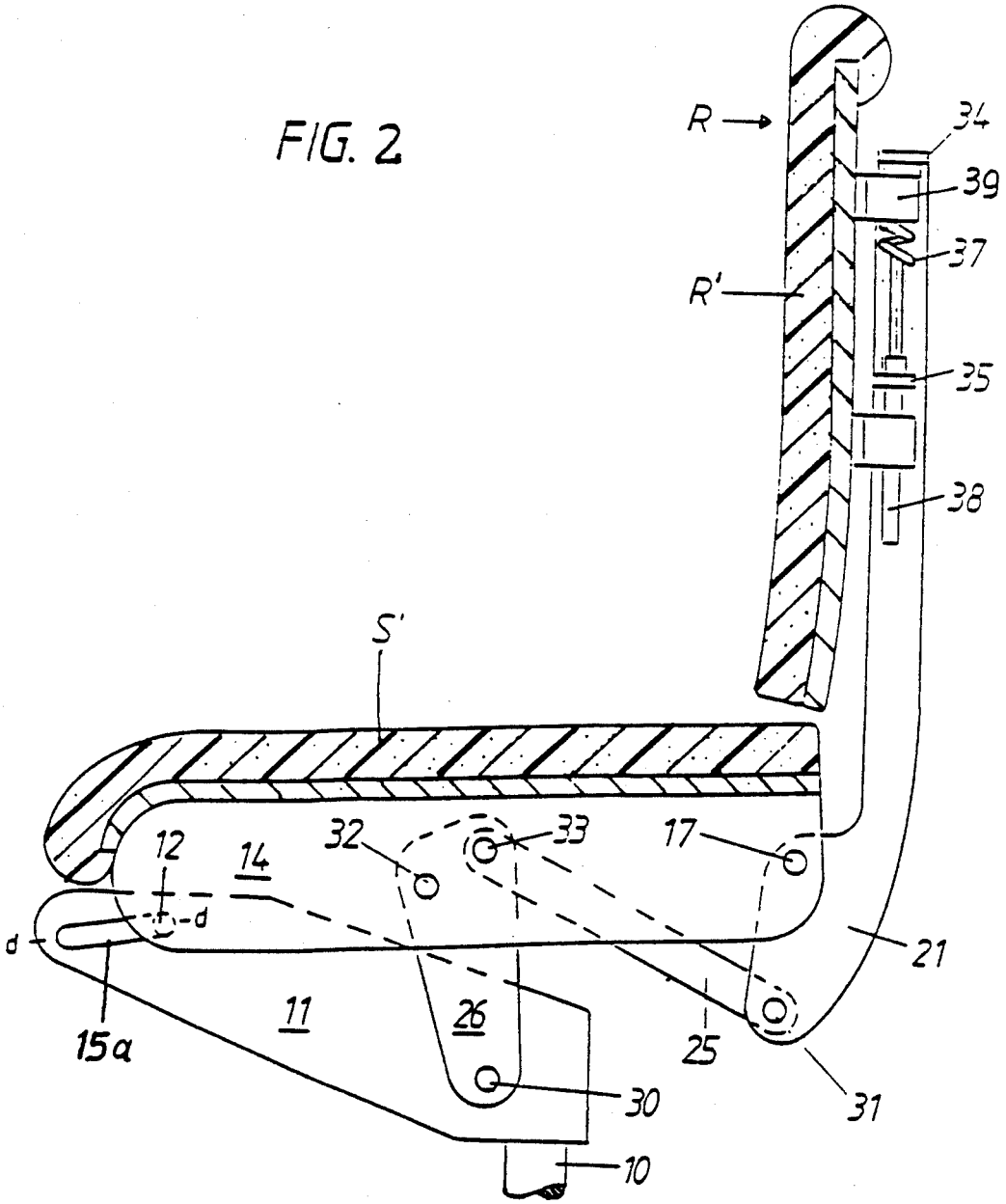

The reclining chair comprises a seat S, which is provided with upholstery S' and has an adjustable inclination. The chair comprises also a back rest R and a base comprising a column 10, which is adjustable in height and supports a seat carrier 11, which extends almost as far as to the forward edge of the seat. The seat S is carried by link means 14, which are pivoted by a first pivot 12 to the forward end of the seat carrier 11. The back rest R is pivoted by a second pivot 17 to the rear end of the link means 14. Shifting means are provided for shifting the chair from a position for work to a position for reclining and to any desired intermediate position.

In position for work the seat S extends approximately horizontally toward the back rest R and includes with the latter an angle of about 90°.

Figure 6:
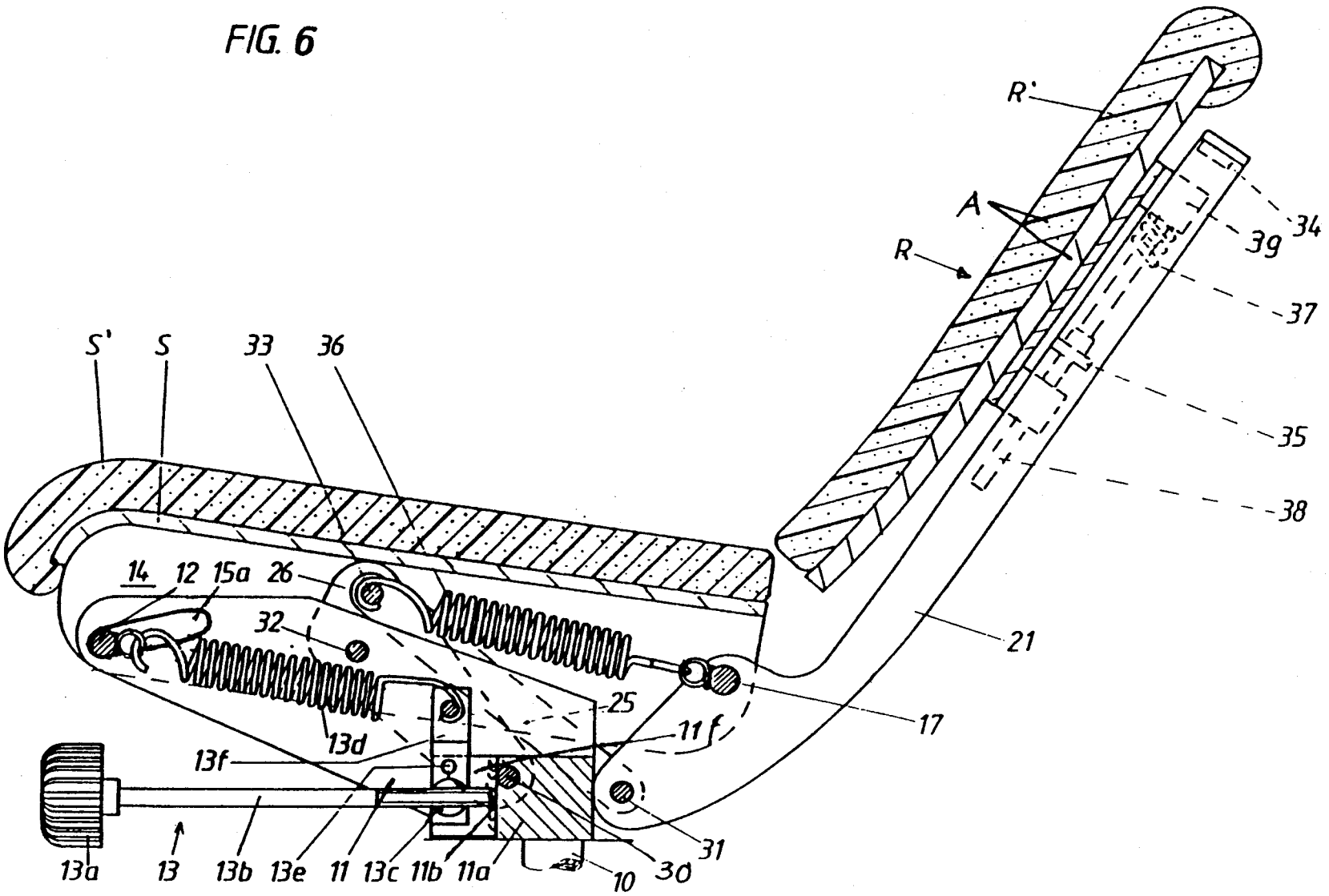
FIG. 6 is similar in FIG. 1 and shows in vertical section the chair with coil springs for returning the chair from its position for reclining to its position for work.
Figure 7:
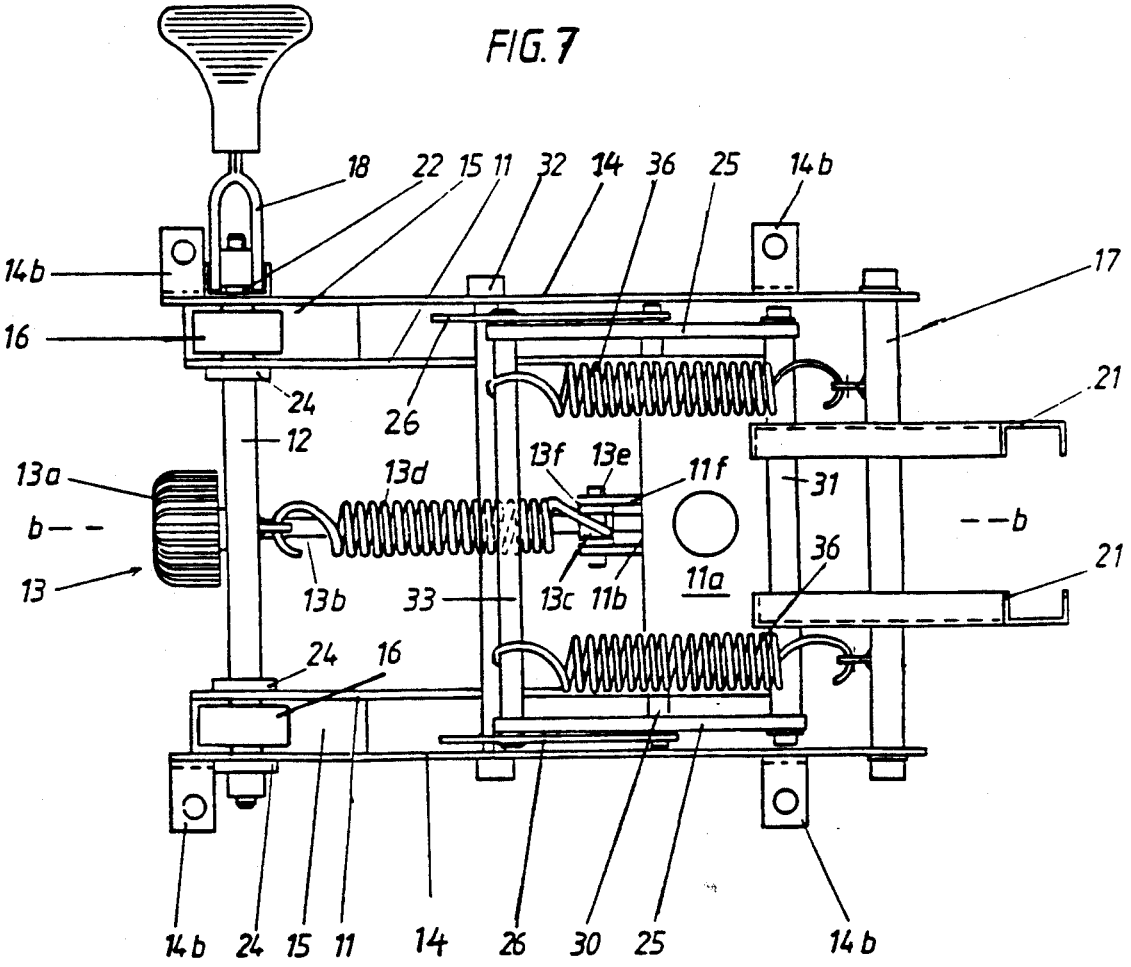
FIG. 7 is a top plan view showing the same arrangement as FIG. 6 when the seat has been removed and the back rest has been removed in part.
Figure 8:
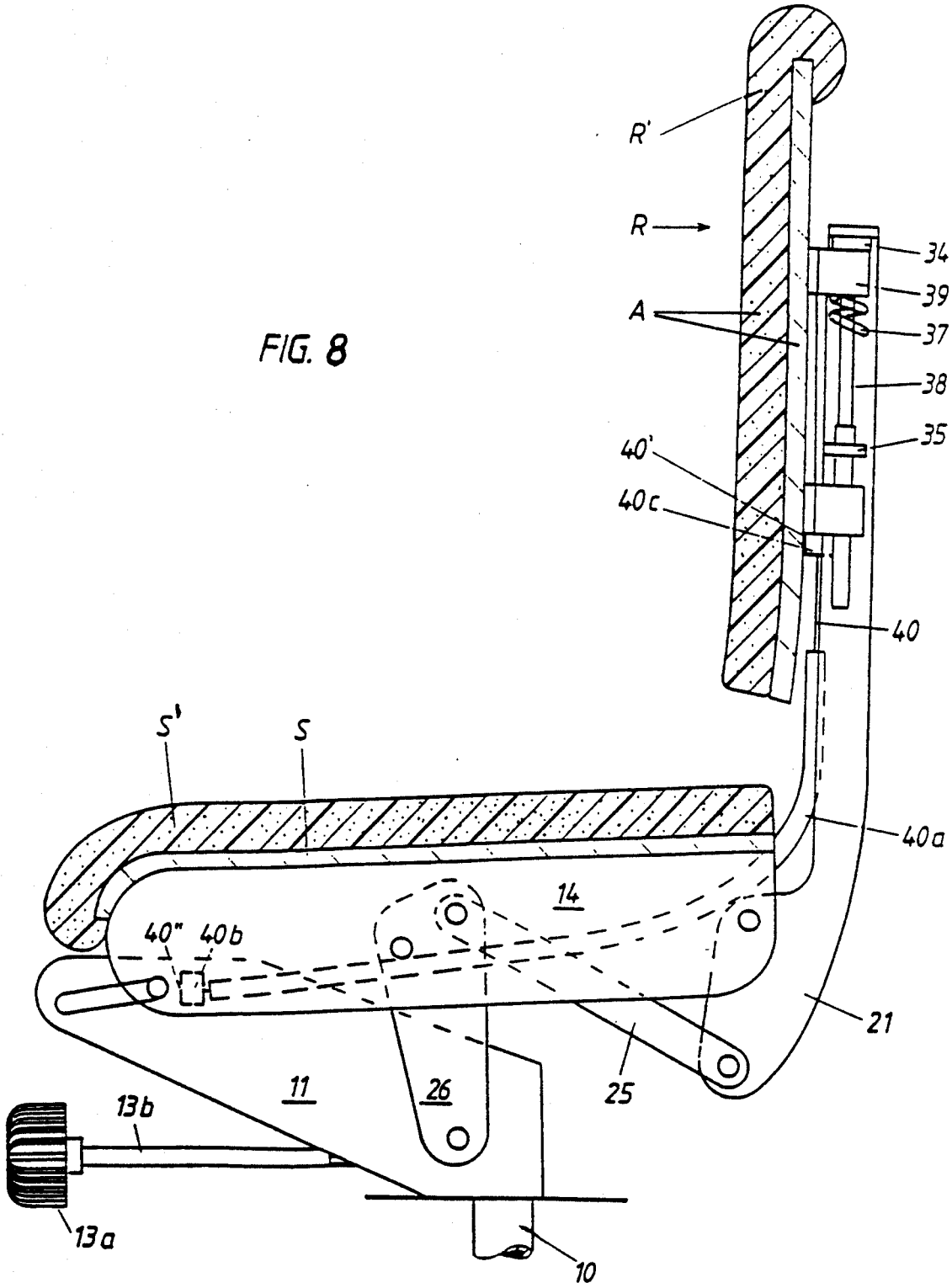
FIGS. 8 and 9 are similar to FIGS. 2 and 1, respectively, and show a modified chair provided with means for effecting a downward displacement of the back-engaging part of the back rest during a shifting of the chair to its position for reclining.
Figure 9:
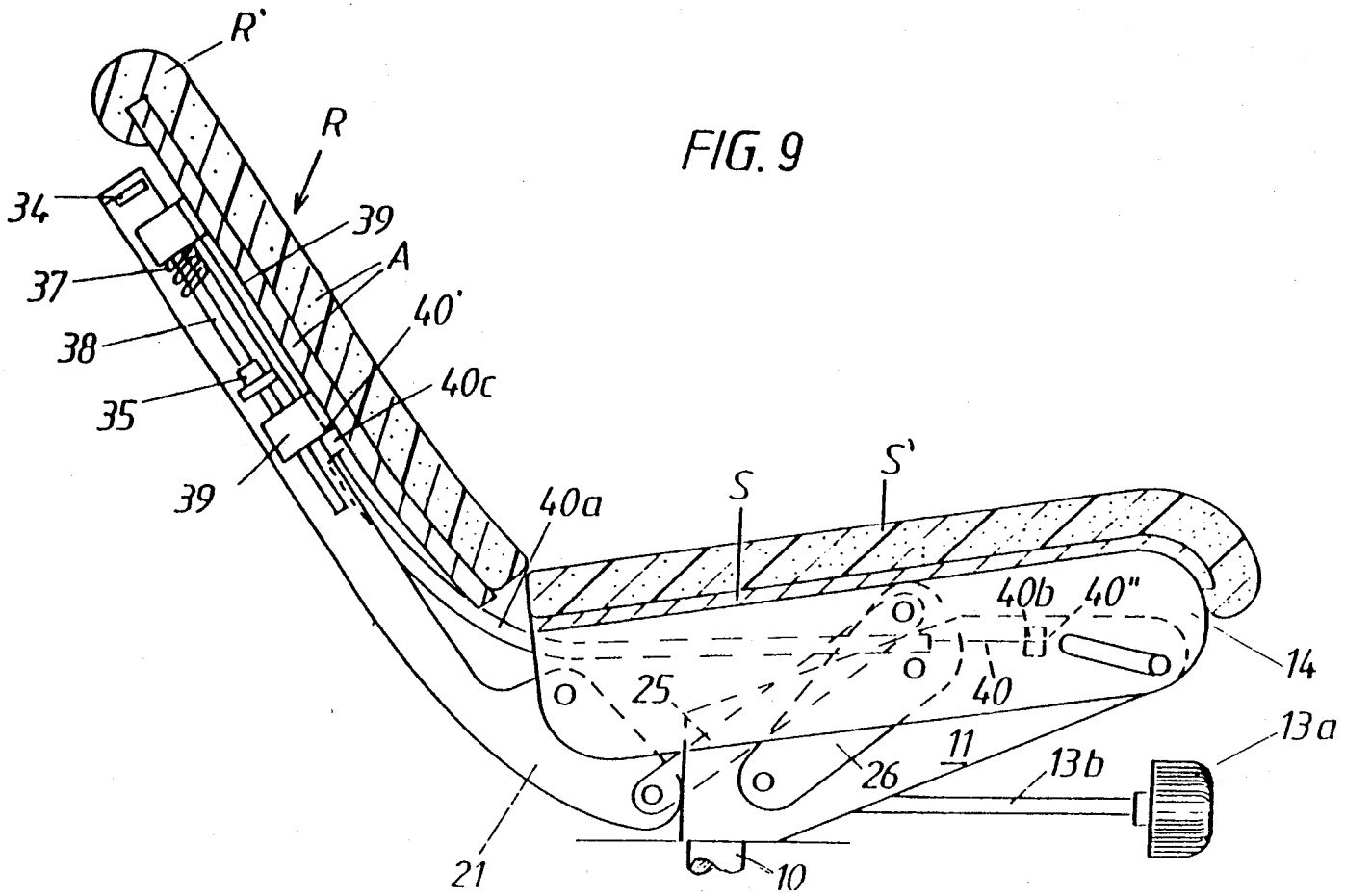

In the position for reclining the seat S has an extremely large inclination to the rear and includes with the back rest R and obtuse angle. For a shifting of the chair from the position for work to the position of rest and to the intermediate positions the back rest R is pivotally moved by the occupant of the chair. This applies also to the shifting from the position for reclining to the position for work. The latter shifting is essentially assisted by spring means shown in FIGS. 6 and 7. The chair can be locked in all adjusted positions by locking means. The seat carrier 11 is provided with slide bearings 15, which are apparent from FIG. 7. Said slide bearings consist of quadrangular-section sleeves or block supports in which sliding blocks 16 fixed to the free ends of the pivot 12 are guided in the direction of the sliding movement. The pivot 12 extends through longitudinal slots 15*a* in the seat carrier 11 and is rigidly joined to the sliding blocks 16. The sliding movement is preformed in a plane of displacement d—d, which is forwardly inclined at an angle of about 15° to the horizontal so that the forward edge of the seat will always assume approximately the same level in the various positions.

For the shifting of the chair from its position for work to its position for reclining the first pivot 12 is adapted to be displaced in the slide bearings 15 to a larger distance from the column.

The displacement results in a displacement of the center of gravity of the unit which consists of the seat S, link means 14, the back rest R and the occupant. As a result of that displacement of the center of gravity the chair cannot tilt even when the back rest has an extreme inclination toward the rear. For the shifting of the chair from its position for work to its position for reclining, the movement performed by the body of the occupant is converted by shifting means to a displacement of said unit.

Figure 3:
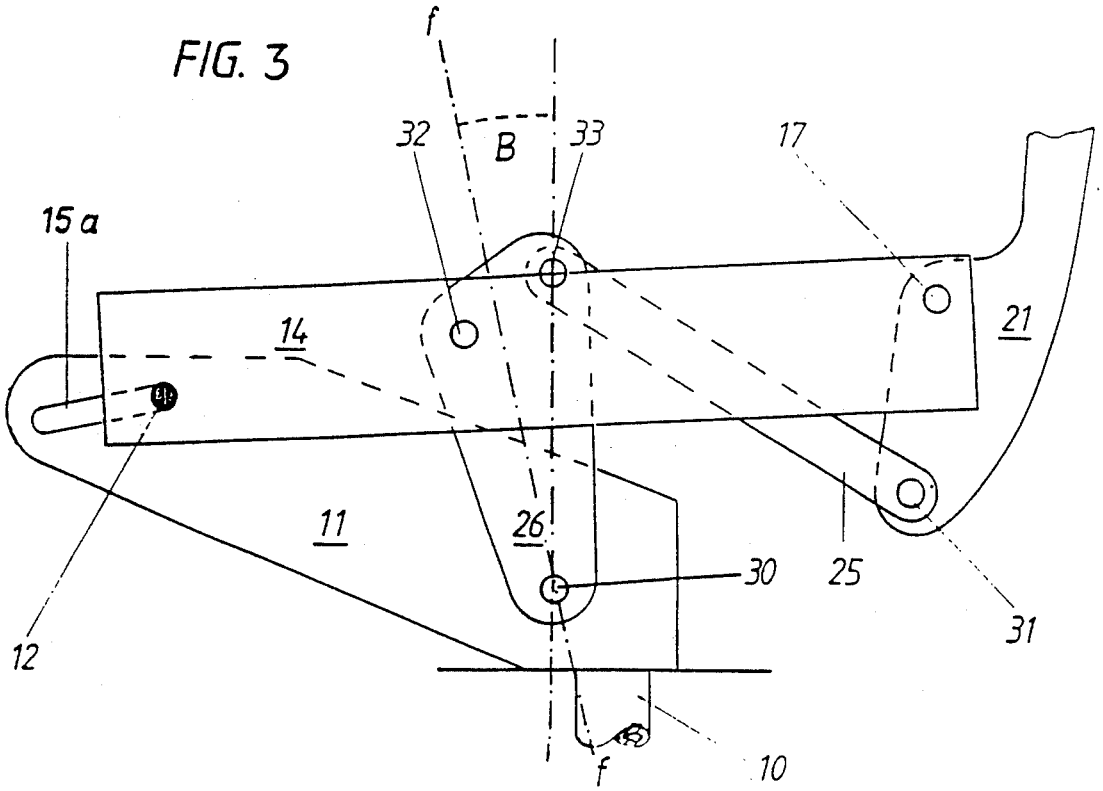
FIGS. 3 and 4 are enlarged fragmentary views of the chair of FIGS. 1 and 2.
Figure 4:
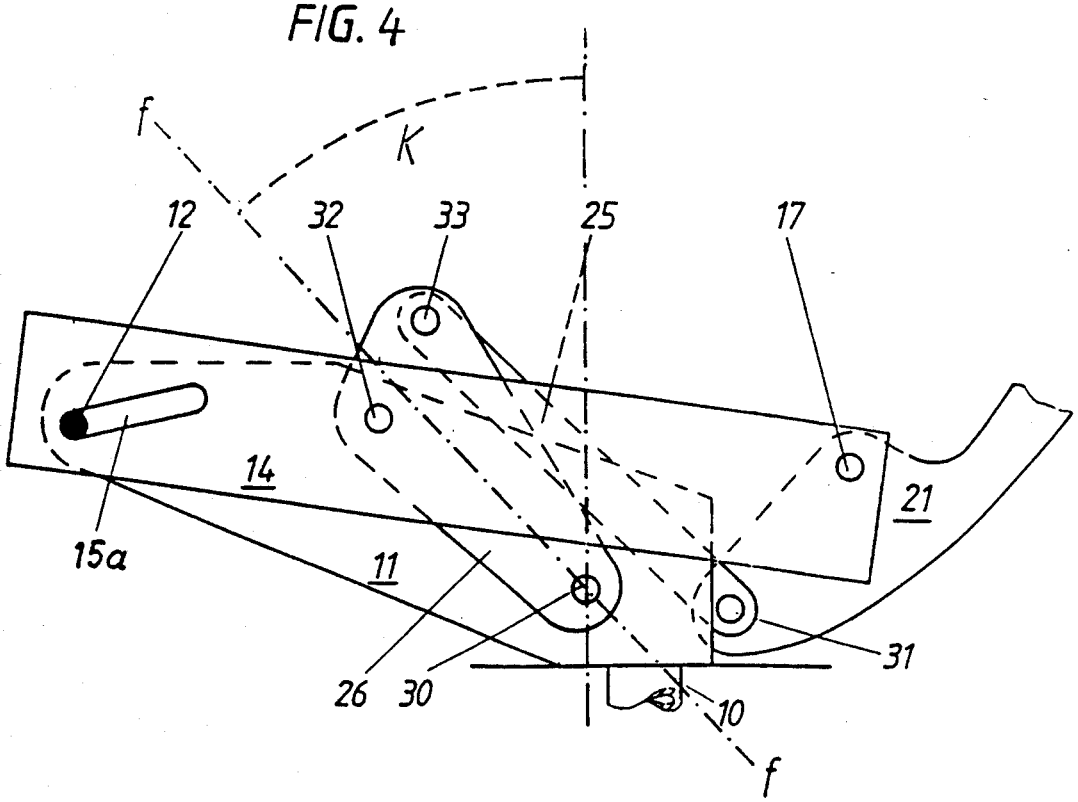
Figure 5:
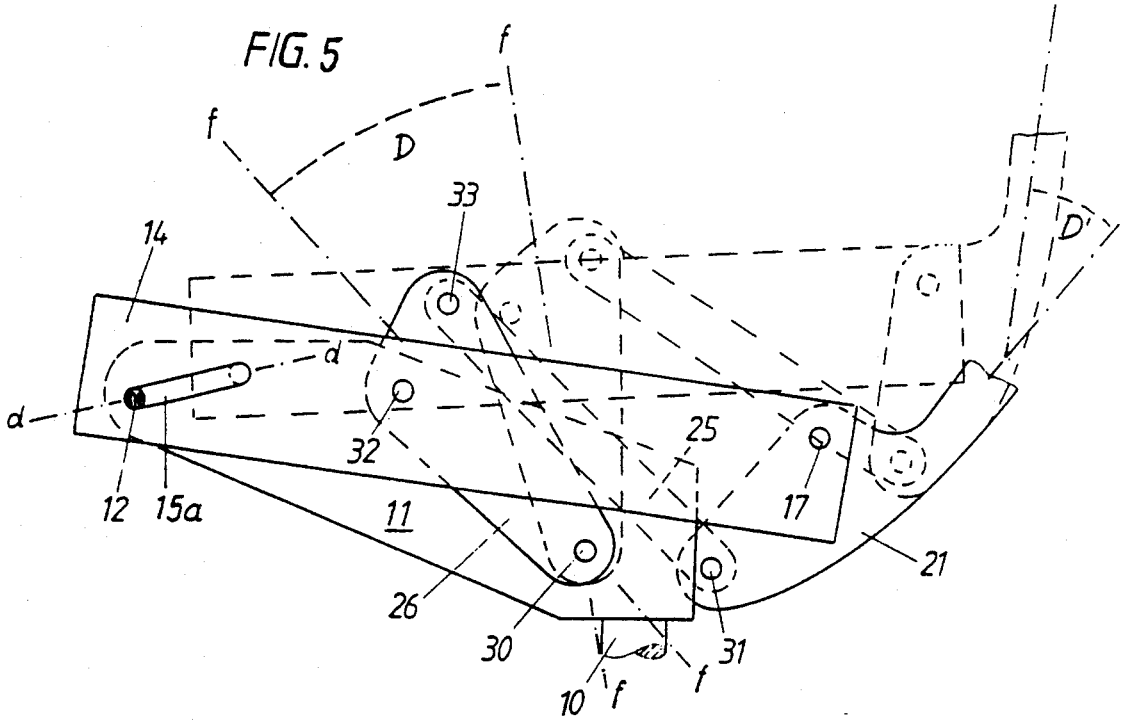
FIG. 5 shows the same arrangement as FIG. 4 and in broken lines shows also the arrangement of FIG. 3.

Said shifting means will now specifically be described: The shifting means essentially comprise two pairs of levers 26, 25, each of which pairs consists of two congruent levers, which are symmetrically arranged with respesct to the vertical longitudinal plane of symmetry b—b (FIG. 7) of the chair. The levers 26 of the first pair are pivoted to the seat carrier 11 by a third pivot 30 and are pivoted to the link means 14 by a fourth pivot 32. The levers 25 of the second pair are pivoted at one end by a fifth pivot 33 to the top of the first levers 26. At the other end, the second levers 25 are pivoted to the back rest by a sixth pivot 31, which is spaced from the second pivot 17. The longitudinal axis f—f (FIGS. 3, 4) of each first lever 26 is forwardly inclined when the chair is in position for reclining, in which the levers 26 include with the vertical an angle K, which is a multiple of the corresponding angle B obtained when the chair is in position for work. The distance between the third pivot 30 and the sixth pivot 31 in the position for work is more than two and a half times the corresponding distance obtained in the position for reclining. For a shifting of the chair from the position for work to the position for reclining the center lines f—f of the levers 26 of the first pair and the back rest R, respectively can be pivotally moved through maximum angles D; D', which are approximately equal (FIG. 5). The first levers 26 have approximately the basic configuration of a triangle having rounded corners, near which the bores for the associated pivots are disposed. During the shifting of the chair from its position for use to its position for reclining all instantaneous centers of rotation which are possible between the link 14 and the seat carrier 11 lie in the plane of displacement d—d, which intersects the pair of levers 26 between the fourth pivot 32 and the fifth pivot 33. The term "instantaneous centers of rotation" describes the instantaneous positions which can be assumed by the axis of the pivot 12 during the displacement of the link means 14. That design will ensure a particularly soft and continuous movement of the seat as the chair is shifted from its position for work to its position for reclining and vice versa because all possible instantaneous centers of rotation between the seat carrier 11 and the link means 14 also lie in a plane which always intersects the first levers 26 in the stated range.

The levers 25 are pivoted by the sixth pivot 31 to the carrying part 21 of the back rest R. The link means 14 are pivoted to the back rest R by the second pivot 17. The third pivot 30 is close to the column 10. The distances from the second pivot 17 and the sixth pivot 31 to the third pivot 30 are so selected that the angular movements performed by the link means 14 and the carrier 21 for the back rest R, respectively, during the shifting to the position for reclining are related approximately as 1:3. The shifting of the chair from its position for work to its position for reclining is opposed by coil springs 36 and **13*d*. The coil springs 36 are connected at one end to the second pivot 17 and at the other end to the fifth pivot 33 and are symmetrically disposed with respect to the vertical longitudinal plane of symmetry b—b. An additional coil spring 13*d* is disposed in the plane or symmetry b—b and bears on an abutment 11*f* provided on the seat carrier 11 and is connected to the first pivot 12. The initial stress of that coil spring 13*d* may be adjustable by suitable means (FIGS. 6, 7), which comprise an adjusting wheel 13*a*, which is operable to move an associated screw 13*b*, which is screwed into the female screw threads of a nut 13*c*. The screw 13*b* bears at one end on an abutment surface 11*b* of the seat carrier 11. The nut 13*c* is connected to a lever 13*f*, which is pivoted on a pivot 13*e* that is disposed below the pivot for the coil spring 13*d*. As a result, the axial component of the movement of the rotating screw 13*b* will impart a pivotal movement to the lever 13*f* so that the initial stress of the coil spring 13*d* is changed. The link means 14 are provided with brackets 14*b*** for mounting the seat S.

The movements performed by the pairs of levers 26, 25, the back rest R and the link means 14 during the shifting operation are illustrated in FIG. 5. The seat S is rearwardly inclined in position for reclining and is slightly forwardly inclined in positiion for work. The back rest is provided with upholstery R'. As is apparent particularly from FIG. 7 the means for locking the chair in its adjusted positions are provided close to the pivot 12, which is tubular and through which a screw bolt 22 extends. In response to a suitable operation of an eccentric member 18 the bolt 22 forces friction washers 24 against the side faces of the seat carrier 11 and the link means 14 in order to lock the link means in their adjusted inclination.

Owing to the provision of the chair with shifting means for deriving a displacement from the pivotal movement imparted to the back rest R by the body of the occupant, the shifting of the chair to its position for reclining will result only in a very small relative movement between the clothes of the occupant and the back rest, because the seat S' is slightly swung down about the pivot 12, and as a result, the angular movement of the back rest R is decreased relative to the angular movement of the seat S'. That relative movement will further be reduced because the back-engaging part A is displaceable parallel to its back-contacting surface and is guided during that displacement by means of guiding elements **39*a* extending into tracks 38 of the back rest carrier 21. That displacement may be opposed by return springs 37 and is limited by steps 34, 25. A further reduction of the relative movement between the clothes of the occupant and the back-engaging part A of the back rest during the shifting to the position for reclining may be enforced by a rope mechanism, which comprises on either side of the vertical longitudinal plane of symmetry b—b a rope 40, which is connected at 40' to the displaceable back-engaging part A of the back rest R and at the point 40'' to a link 14. A sheath 40*a* for the rope is secured to the seat carrier 11. During the displacement of the link means, a connecting socket 40*b* provided on the rope 40 will be pulled out of the sheath 40*a* so that the socket 40*c* by which the rope 40 is connected to the back-engaging part A is pulled toward the rear end of the sheath 40*a* against the restorting force of the coil spring 37**.

I claim:

1. In a reclining chair comprising a base structure including a vertically adjustable column, a back rest, a seat carrier supported by said column and having a forward end, link means pivoted by a first pivot disposed in the front of said column to said seat carrier at the forward end thereof and by a second pivot disposed behind said column to said back rest, a seat carried by said link means, said chair being adapted to assume a position for work, in which said seat is approximately horizontal and includes an angle of about 90° with said back rest, a position for reclining, in which said seat is rearwardly inclined and includes an obtuse angle with said back rest, and a plurality of intermediate positions between said positions for work and for reclining.

locking means for locking said chair in any of said positions, and spring means operatively connected to said back rest and said link means for urging said chair from said position for reclining to said position for work, the improvement comprising shifting means connected to said back rest at a location spaced from said second pivot and to said link means for imparting to said link means forward and rearward displacements, respectively, in response to a pivotal movement imparted to said back rest by said occupant to shift said chair from said position for work to said position for reclining and from said position for reclining to said position for work; said first pivot being carried by said link means and being mounted in said seat carrier in slide bearings for guiding said first pivot relative to said seat carrier during said forward and rearward displacements of said link means.

2. The improvement set forth in claim 1, wherein said shifting means comprises a) a pair of first levers pivoted by a third pivot to said seat carrier and pivoted by a fourth pivot to said link means, and b) a pair of second levers pivoted at one end by a fifth pivot to said first levers at the top thereof and pivoted at another end to said back rest by a sixth pivot spaced from said second pivot.

3. The improvement set forth in claim 2, wherein each of said first levers has a longitudinal center line forwardly inclined when said chair is in position for reclining and forming with the vertical an angle which is a multiple of the corresponding angle obtained when the chair is in position for work and said third and sixth pivots are spaced apart by a distance which when the chair is in position for work is more than one and a half times the corresponding distance obtained when the chair is in position for reclining.

4. The improvement set forth in claim 2, wherein each of said first levers has a longitudinal center line moving angularly through a first angle up to a predetermined maximum during a shifting of the chair from said position for work to said position for reclining, said back rest is arranged to perform a pivotal movement through a second angle up to a predetermined maximum during said shifting from said position for work to said position for reclining, and the predetermined maxima of said first and second angles are about the same.

5. The improvement set forth in claim 2, wherein said chair has a vertical longitudinal plane of symmetry, the levers of each of said pairs are congruent and symmetrically arranged with respect to said plane of symmetry, and each of said first levers has approximately the configuration of a triangle having rounded corners, and is formed near said corners with bores for said third, fourth and fifth pivots.

6. The improvement set forth in claim 2, wherein said chair has a vertical longitudinal plane of symmetry and said springs comprise first and second coil springs symmetrically disposed with respect to said plane of symmetry and connected to said second and fifth pivots and a third coil spring disposed in said plane of symmetry and having one end abutting on said seat carrier and another end connected to said first pivot, and means for adjusting an initial stress of said third coil spring.

7. The improvement set forth in claim 2, wherein said slide bearings are arranged to guide said first pivot for said displacements in a plane extending at an angle of about 15° to the horizontal; said slide bearings comprising block supports in each of which a sliding block is slidably guided, further comprising means defining longitudinally extending slots in said seat carrier and said first pivot having mutually opposite ends, each extending through a respective said slot and being fixed to said block.

8. The improvement set forth in claim 7, wherein said plane intersects said first levers between said fourth and fifth pivots during a shifting motion of said chair between said position for work and said position for reclining and said first pivot has an axis which is arranged to extend in said plane throughout the shifting motion.

9. The improvement set forth in claim 2, wherein said third pivot is disposed adjacent to said column and said second and fourth pivots are spaced such distances apart from said third pivot that angular movements performed by said shifting means and said back rest, respectively, during the shifting of said chair from said position for work to said position for reclining are related as about 1:3.

10. The improvement set forth in claim 1, wherein said back rest comprises a back-engaging part adapted to be engaged by an occupant seated on said seat and a back rest carrier, which carries said back-engaging part and is pivoted to said link means by said second pivot.

11. The improvement set forth in claim 10, wherein said back-engaging part is slidably mounted on said back rest carrier for a movement toward and away from said second pivot, said chair has a vertical longitudinal plane of symmetry, two ropes are provided, which are disposed on opposite sides of said plane and each of which is connected at one end to said back-engaging part and at the other end to said link means and is arranged to pull said back-engaging part toward said second pivot as said chair is shifted from said position for work to said position for reclining, and said back rest comprises spring means urging said back-engaging part away from said second pivot.

* * * * *